US005746641A

United States Patent [19]

Wong

[11] Patent Number: 5,746,641

[45] Date of Patent: May 5, 1998

[54] TOY

[75] Inventor: Tak-Ko Wong, Hong Kong, Hong Kong

[73] Assignee: T.K. Wong & Associates Ltd., Chaiwan, Hong Kong

[21] Appl. No.: 888,861

[22] Filed: Jul. 7, 1997

[30] Foreign Application Priority Data

Aug. 5, 1996 [GB] United Kingdom ..... 9616403

[51] Int. Cl.[6] ..... A63H 17/00

[52] U.S. Cl. ..... 446/431; 446/441; 446/466

[58] Field of Search ..... 446/6, 168, 169, 446/269, 279, 389, 138, 139, 291, 324, 316, 431, 441, 445, 466, 469

[56] References Cited

U.S. PATENT DOCUMENTS

| | | | |
|---|---|---|---|
| 3,061,972 | 11/1962 | Wigal | 446/279 |
| 3,638,354 | 2/1972 | Morrison . | |
| 4,764,148 | 8/1988 | Wong | 446/431 |
| 4,884,989 | 12/1989 | Wong | 446/431 |
| 5,549,501 | 8/1996 | Jow | 446/466 |
| 5,683,285 | 11/1997 | Wong | 446/289 |

FOREIGN PATENT DOCUMENTS

| | | | |
|---|---|---|---|
| 55-78984 | 6/1980 | Japan | 446/431 |
| 55-78983 | 9/1980 | Japan | 446/431 |
| 696660 | 9/1953 | United Kingdom | 446/289 |
| 2123704 | 2/1984 | United Kingdom | 446/445 |

*Primary Examiner*—Robert A. Hafer
*Assistant Examiner*—Jeffrey D. Carlson
*Attorney, Agent, or Firm*—Miller, Sisson, Chapman & Nash, P.C.

[57] ABSTRACT

A wall walker toy car has a wheel with a sticky peripheral surface that normally extends partially out of a car body. The wheel is supported on a pivotable frame that responds to impact on a part, which would move relatively, to allow the frame to move up under the action of a spring cushion. A second position of the wheel is shown dotted where the wheel is fully retracted into the body so that the sticky surface is less exposed to dust and dirt and therefore has a longer serviceable life in practice.

5 Claims, 1 Drawing Sheet

TOY

BACKGROUND OF THE INVENTION

1. Field of the Invention

The invention relates to toys.

2. Description of Prior Art

The invention relates more particularly to "wall walker" toys that include one or more wheels having sticky peripheral surfaces. The toys may be in the form of cars, aeroplanes, cartoon characters and so forth that run on vertical or steeply inclined surfaces. The peripheral surfaces are often partly enveloped in a body of the car, aeroplane or cartoon character and exposed sufficiently to bear against the vertical surface during travel of the toy down the surface. Total or partial exposure leads to the sticky surface becoming easily spoiled and contaminated so as to be less useful, or even useless in due course, in holding the toy properly to the surface during use.

SUMMARY OF THE INVENTION

It is an object of the invention to overcome or at least reduce this problem.

According to the invention there is provided a wall walker toy having a sticky surfaced wheel mounted inside a body of the toy in a first position with its surface partially exposed outside the body, in which the wheel is movable to a second position where the wheel is positioned wholly within the body, and an externally accessible operating mechanism arranged on physical impact to cause the wheel to move from its first position to its second position.

The operating mechanism is preferably arranged to respond to an impact at a front of the toy.

The operating mechanism may have a part that is externally accessible and manually movable to cause the wheel to move from its second position to its first position.

The wheel may be supported on a frame that is pivotably mounted inside the body.

The wheel is preferably biassed into either the first position or the second position at all times by the same biassing means.

BRIEF DESCRIPTION OF THE DRAWINGS

A wall walker toy car according to the invention will now be described by way of example with reference to the accompanying drawings in which.

DESCRIPTION OF THE PREFERRED EMBODIMENTS

Figure 1:
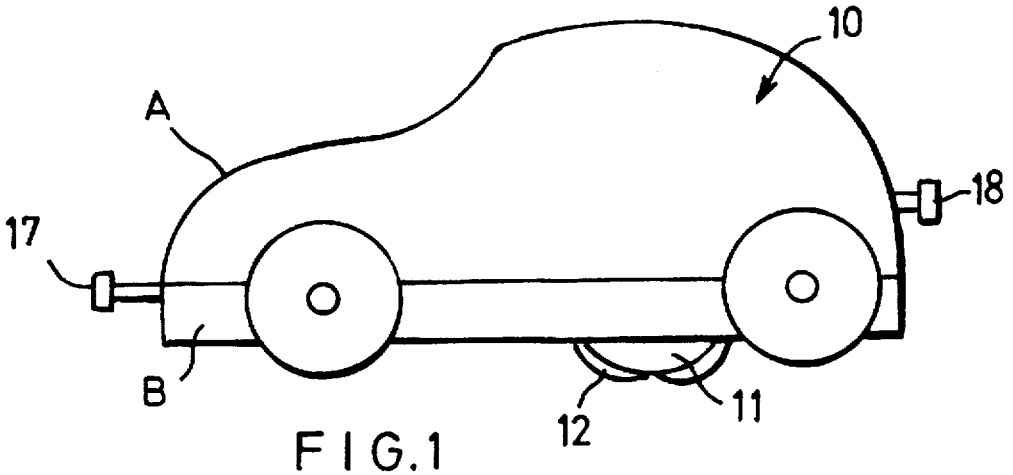
FIG. 1 is a side view of the car.

Referring to the drawings, the car has a hollow body 10 formed in two parts A and B held together by a screw 10A. A wheel 11 has an undulated sticky peripheral surface 12 and is mounted inside the body. The wheel has a first position shown in FIG. 2 in full and a second position shown dotted in FIG. 2. In the first position the wheel is partly exposed outside the body 10 and in the second position the wheel 11 is for all intents and purposes wholly inside the body 10.

The wheel 11 is supported by a rectangular frame 13 that includes an axle 14 at one end that is held between opposing semi-circular axles stands 15. The axle stands are integrally moulded with upper and lower parts A and B of the body 10 respectively. When the body parts are brought together the axles stands surround the axle 14 and allow the frame 13 to pivot as required. An operating mechanism comprises a second rectangular frame 16 that slidingly fits against inner surfaces of the body 10 and has integrally formed externally accessible parts 17 and 18. A cross-piece 19 of the frame 16 is mounted generally above a similar cross-piece 20 of the frame 13 that is provided with an upstanding probe 21. A plastic spring cushion 22 is mounted below the probe 21 and bears against the body 10.

Figure 2:
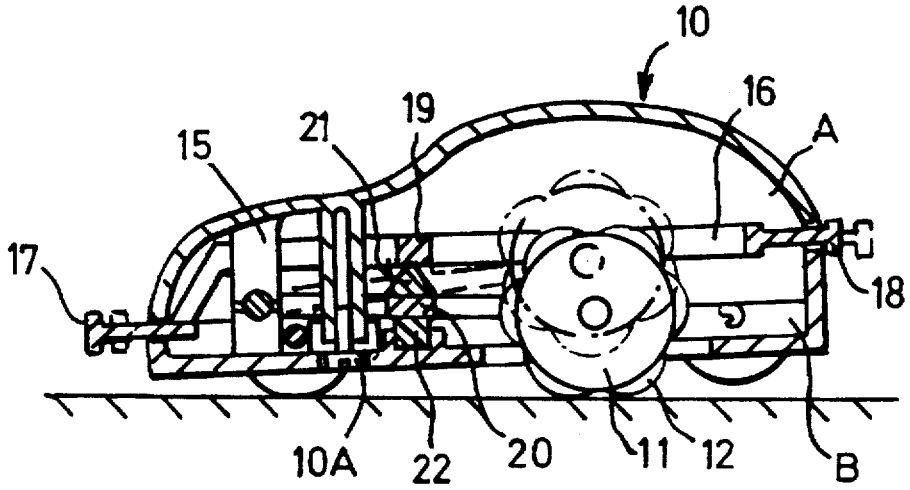
FIG. 2 is a sectional side view of the car.
Figure 3:
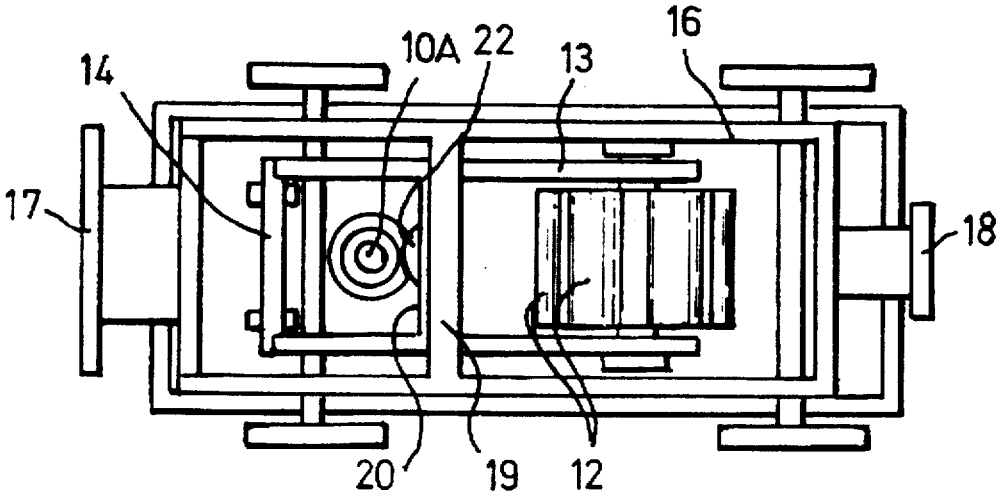
FIG. 3 is a sectional top plan view of the car.

Referring particularly to FIG. 2, when the car is moving forwards and the part 17 impacts an obstruction, the frame 16 is moved relatively to the right so that the cross-piece 19 moves to the right. The probe 21 and the frame 13 then move up, due to the bias of the spring cushion 22. As a result, the wheel 11 moves up into the body 10. To move the wheel 11 down again, the part 18 must be pushed relatively to the left so that the cross-piece 19 presses against the probe 21 to push down the frame 13 and hence the wheel 11.

The described automatic action of the operating mechanism ensures that when the toy is used and it impacts against an obstruction, usually the floor at the end of its run down a vertical surface, the wheel 11 is immediately withdrawn inside the body. The wheel 11 can also be withdrawn simply by manually pressing the part 17. As a result, the sticky peripheral surface of the wheel 11 is not exposed so much to become contaminated by fluff, dust and the like on the floor, or on the surface of a storage shelf when not in use. The surface 12 therefore remains in good condition for a much longer overall period of use and play. Further, when the wheel is withdrawn, the car can be used for normal play on a horizontal surface for example and run on its four conventional wheels shown in the drawings.

It will be noted that the main reason for an automatic operation of the operating mechanism, and which is particularly important, is the movement of the wheel from its first position to its second position. Thus, it is noted that the part 17 is externally accessible and on impact causes the wheel 11 to be retracted into the body 10. Re-setting or returning the wheel, from the second position to the first position, is normally less important and may be arranged to be done in other mechanical ways than described. For example, the frame 16 can be moved to the left by inserting and manipulating a screw-driver, or similar, into the body 10. In short, this part of operation arranged by a part accessible externally of the body, therefore may not be "automatic".

It will also be noted that the spring cushion 21 biasses the frame 16 upwards at all times. This ensures the wheel 11 lifts up when impact occurs. The bias also serves to hold the frames 16 and 17 in a stable relative position when the wheel is in the second position. The single spring cushion is configured and positioned to provide a suitable stabilising bias for retaining the frame 16 and the wheel 11 in both the first and second positions as required.

I claim:

1. A wall walker toy having a sticky surfaced wheel mounted inside a body of the toy in a first position with its surface partially exposed outside the body, in which the wheel is movable to a second position where the wheel is positioned wholly within the body, and an externally accessible operating mechanism arranged on physical impact to cause the wheel to move from its first position to its second position.

2. A wall walker toy according to claim 1, in which the operating mechanism is arranged to respond to an impact at a front of the toy.

3. A wall walker toy according to claim 1, in which the operating mechanism has a part that is externally accessible and manually movable to cause the wheel to move from its second position to its first position.

4. A wall walker toy according to claim 1, in which the wheel is supported on a frame that is pivotably mounted inside the body.

5. A wall walker toy according to claim 1, in which the wheel is biassed into either the first position or the second position at all times by the same biassing means.

* * * * *